US009469151B2

(12) United States Patent
Feuerstein

(10) Patent No.: US 9,469,151 B2
(45) Date of Patent: Oct. 18, 2016

(54) APPLICATION TOOL

(71) Applicant: Jurgen Feuerstein, Lahr (DE)

(72) Inventor: Jurgen Feuerstein, Lahr (DE)

( * ) Notice: Subject to any disclaimer, the term of this patent is extended or adjusted under 35 U.S.C. 154(b) by 11 days.

(21) Appl. No.: 14/383,305

(22) PCT Filed: Feb. 27, 2013

(86) PCT No.: PCT/EP2013/000571
§ 371 (c)(1),
(2) Date: Sep. 5, 2014

(87) PCT Pub. No.: WO2013/131623
PCT Pub. Date: Sep. 12, 2013

(65) Prior Publication Data

US 2015/0023719 A1 Jan. 22, 2015

(30) Foreign Application Priority Data

Mar. 6, 2012 (EP) ..... 12001510

(51) Int. Cl.
*B43K 8/04* (2006.01)
*B43K 8/00* (2006.01)
*B43K 11/00* (2006.01)
*B43L 19/00* (2006.01)

(52) U.S. Cl.
CPC ..... *B43K 8/04* (2013.01); *B43K 8/003* (2013.01); *B43K 11/00* (2013.01); *B43L 19/0018* (2013.01); *B43L 19/0068* (2013.01)

(58) Field of Classification Search
CPC combination set(s) only.
See application file for complete search history.

(56) References Cited

U.S. PATENT DOCUMENTS

| | | | | |
|---|---|---|---|---|
| 1,913,466 A | | 6/1933 | Ackermans | |
| 2,458,027 A | * | 1/1949 | Quist | A45D 34/04 222/187 |
| 2,637,466 A | * | 5/1953 | Wright | B43K 5/1845 222/183 |
| 3,113,336 A | * | 12/1963 | Langnickel | B43K 5/1845 401/198 |
| 3,337,899 A | | 8/1967 | Rentfrow | |

FOREIGN PATENT DOCUMENTS

| | | |
|---|---|---|
| GB | 252428 | 5/1926 |
| JP | 6121412 | 2/1986 |

* cited by examiner

*Primary Examiner* — David Walczak
(74) *Attorney, Agent, or Firm* — Volpe and Koenig, P.C.

(57) ABSTRACT

A pencil type application tool for applying a coating material to a substrate, having a shaft and a reservoir in the shaft filled with the coating material. A tool head having an applicator, and a valve is arranged between the reservoir and the tool head, that has a valve body and, upon actuation, switches from a closed to an open position to dispense the coating material onto the substrate. In order to reduce the consumption of application tools and also permit refilling with a coating material in a reliable and clean manner, in the longitudinal extension of the application tool between the shaft and the tool head, a carrier part is arranged which receives and secures the valve body by the main part of its longitudinal extension, in a direction facing away from the applicator, and the carrier part is detachably connectable to the shaft and the tool head.

13 Claims, 1 Drawing Sheet

APPLICATION TOOL

BACKGROUND

The invention relates to an application tool in the manner of a crayon or pencil, for applying a coating material to a substrate surface, having a shaft, on which the tool can be gripped, and having a reservoir which is accommodated in the shaft for supplying with the coating material, the tool being provided with a tool head which has an applicator and by means of which the coating material passes onto the substrate surface, and having a valve which is arranged between the reservoir and the tool head with its valve body which, upon actuation, changing from a closed position into an open position and, in the latter position, discharges a quantity of the coating material from the reservoir to the applicator for application to the surface.

Application tools of this type are well known for applying a protective, decorative or functional layer and are often configured in a type of pen form, with the result that they can be handled particularly simply, differently shaped applicators making very different ways of application possible. Here, a common feature of the different application tools can be, for example, that the valve actuation is triggered by way of exertion of a certain pressure by the operator via the shaft on the applicator or a part which is connected to the latter, which valve actuation brings about the release of the coating material from the reservoir. In the growing, so-called "fine art" field in the sector of decorative coatings, for example, application tools of this type can be configured for instance as so-called pump markers in pen form. In addition, the application tools in general and their reservoirs can also be provided with other containers which can be closed for instance by way of connections which are to be screwed or plugged.

For example, GB 252 428 A has disclosed a pen-like application tool for the application of ink, in which application tool a cosmetic which is to be applied to a surface or an ink as coating material is solid form is to make contact directly with the substrate surface and is supplied with a solvent from a reservoir. Moreover, JP 61 021412 U has disclosed a pen-like application tool which is capable of discharging a coating material. In said application tool, the reservoir is configured as a container which is independent of the shaft and can be fed in for replacement purposes from the side which faces away from the applicator, as a result of which refilling requires a certain dexterity and is often associated with undesired contamination.

After emptying of its reservoir, the application tool can be passed to recycling, which can be the case relatively rapidly in the case of a correspondingly intensive use or limited reservoir. In order to avoid this, it has firstly already been proposed to refill the reservoir of the application tool via a closable opening in the rear region, in particular on a bottom face of the application tool. This is usually complicated and not a particularly satisfactory solution due to the usually existing instability of the tool in the upright state, since, during refilling, falling over of the tool constantly has to be feared with corresponding contamination in the surroundings by way of the coating material. The proposal to deposit the tool on its bottom which faces away from the tool head and to remove a valve which is held in an opening of the reservoir for refilling appears to be likewise complicated and not very practicable because the manufacture of the application tool would be made tremendously more expensive as a result. In order to provide a minimum amount of stability for this operation, the bottom region of the tool would possibly have to be expanded disproportionately in comparison with its other dimensions, and secondly removal and reattachment of the valve without contamination taking place would be extremely rare.

SUMMARY

It is therefore the object to provide an application tool which firstly reduces the consumption of application tools per se and secondly allows them to be refilled with a coating material reliably and cleanly.

This object is achieved by way of an application tool of the type mentioned at the outset, in which a carrier part is arranged between the shaft and the tool head in the longitudinal extent of the application tool, which carrier part receives and fixes the valve body of the valve with the predominant part of its longitudinal extent in the direction which faces away from the applicator, and in which the carrier part is provided such that it can be connected in each case in a releasable manner to the shaft and the tool head of the tool. Accordingly, the carrier part can receive the valve of the application tool, as a result of which said application tool can be prepared in a simple way for filling or refilling with the respective coating material, without there being the fear that this would be associated with unintentional contamination of the surroundings. At the same time, the reservoir size and consumption of the respectively stored coating material quantity in the reservoir of the application tool is no longer the criterion which fixes its end of use when the tool is used, because, for instance, the valve could previously be removed only with considerable damage, for example, of the shaft, with the result that a not inconsiderable contribution to relieving the recycling branch is now made which also appears rather remarkable under environmental aspects. A rather remarkable side effect which emphasizes the sustainability here is that the filling quantity of the reservoir is extended by the volume which is enclosed by the carrier part during its use.

One embodiment of the application tool which can be handled satisfactorily during the refilling operation can be formed by virtue of the fact that the carrier part is formed by a sleeve which receives the valve at least over part of its longitudinal extent, in particular receives the predominant part of the longitudinal extent of the valve body. Since the relevant sleeve encloses the valve and its body, it can advantageously be gripped without the relevant person already coming into contact with the coating material in the process.

In a further advantageous embodiment of the application tool, the valve body forms a rotational body which is invariant during any possible rotational operations about its longitudinal axis, and said valve body is provided with an annular flange which covers the opening edge of one end of the carrier part in the use position of the valve body, with the result that an end-side closure of the carrier part is formed at the relevant end of the carrier part by way of the flange and the valve, which closure can close the reservoir of the shaft. Moreover, in the case of a corresponding edge-side configuration of the flange itself, said flange can advantageously terminate flush with the outer side of the side wall of the carrier part, as a result of which its contour is continued.

One embodiment of the application tool which can be manufactured inexpensively can provide that the valve is held on the carrier part by way of a fixing means, one region of an outer side wall of the valve body, in particular, forming a press fit with an inner side wall of the carrier part.

One embodiment of the application tool which is simple to handle can provide in each case one connecting means at the ends of the carrier part which face the tool head and the shaft of the bearing tool, in particular can provide the two connecting means so as to be similar, with the result that said parts of the application tool can be disassembled and reconnected simply and rapidly.

In one preferred embodiment of the application tool, the connection between the shaft and the carrier part and between the tool head and the carrier part can be realized in a simple way by way of, in particular, similar connecting means by virtue of the fact that, along its longitudinal extent, the carrier part has a region with an internal thread and a region with an external thread. However, it goes without saying that other connecting means can also be provided, such as snap-action or latching connections which permit simple assembly and dismantling.

In order to obtain a uniform outer contour of the application tool, in one particularly preferred embodiment of the application tool, in a continuation of the contour of the shaft while assuming its cross section, the external thread can be provided on a recess of the outer wall of the carrier part, as a result of which, when the tool head is arranged on the carrier part, a contour which is substantially free from projections and recesses in the region of the shaft and its extension in the direction of the tool head of the application tool can be realized. Here, that region of the outer wall of the carrier part which is provided with the internal thread can continue the outer wall of the shaft and is itself in turn continued by the outer wall of that region of the tool head of the application tool which is provided with an internal thread, which region engages over the external thread of the carrier part in the use position.

One development of the application tool which also aids the manufacture of the tool with regard to the shape design can be provided with a shaft which has a substantially constant, circular cross section over its longitudinal extent. In further embodiments, however, the cross section of the application tool itself can also change continuously or suddenly.

In a further embodiment of the application tool, however, the shaft, the carrier part and that region of the tool head which faces the carrier part can preferably overall form a substantially cylindrical contour in the joined together state in the use position, as a result of which, in particular, a plurality of tools can be stored and transported in a particularly satisfactory and space-saving manner.

In one advantageous embodiment of the application tool according to the invention, the shaft of the application tool can be provided from a flexurally rigid material, with the result that, when the shaft is gripped, at any rate a sufficiently high pressure for actuating the valve can be transmitted to the tool head and its applicator can be guided reliably on the surface which is to be coated. For this purpose, the shaft can be provided from a metallic or a plastic material. Moreover, in a further embodiment, the material of the shaft can also be configured to be either transparent or at any rate opaque enough that the coating material is distinguished from the shaft material and permits observation of the filling level. For this purpose, another embodiment can provide a transparent or opaque window or the like recess on the shaft of the tool.

In order for it to be possible to discharge an increased quantity of the coating material during coating of the relevant surface, one expedient development of the application tool can consist in that the shaft of the application tool is provided so as to be elastic at least in regions in such a way that it can be deformed temporarily by way of a manually applied pressing force which squeezes the shaft within certain limits. An elasticity of this type can be achieved, for example, by way of a plastic material which is provided for this purpose or more generally by way of material weakening over a region of the shaft length.

In order, in particular in the decorative field, for it to be possible to satisfactorily distribute the coating material, for example as an ink application, on the relevant substrate surface by way of the application tool and in the process to particularly effectively realize the production of a covering, continuous, solid film of coating material, it is provided in a further advantageous embodiment of the application tool according to the invention to configure the applicator with a fibrous structure or capillary structure which is capable of discharging paint-like coating materials. Here, in particular, said coating materials can be provided as physically drying paints and/or solvent-free paints on an acrylic basis. If the coating material is provided as a physically drying paint, largely residue-free evaporation of the solvent of the coating material can rule out negative influencing of the binder on the applied coating material. These are preferably coating materials with polymer dispersions as the binder which are capable of forming a continuous film upon evaporation of the solvent. The coating material can particularly preferably be a paint formed of an acrylic. However, other coating materials which form a preferably continuous, covering film on the surface by way of drying can be applied to the relevant surface by way of the application tool.

In order for it to be possible to vary the application of the coating material with the use of the same application tool, in particular with regard to the quantity and coating thickness, but also in order for it to be possible to easily replace the applicator for a similar and equivalent replacement after the use limit of said applicator is reached, in one expedient development of the application tool, the applicator of the tool head can be provided such that it can be exchanged.

By way of another development, in which the applicator of the application tool is protected against unintentional damage or drying out when not in use, the application tool can be provided with a protective cap in the region of its tool head when not in use, which protective cap, for example, can be plugged onto the tool head or can be screwed to the latter.

Moreover, the abovementioned object is also achieved by way of a carrier part for use with an application tool for applying a coating material to a substrate surface, in particular an above-described application tool. Application tools which have already been used can namely also be retrofitted with the abovementioned carrier part, it being possible here for the used valve to be used further or else to be replaced by a replacement valve.

BRIEF DESCRIPTION OF THE DRAWINGS

In the following text, the invention will be explained in greater detail using exemplary embodiments in the drawing, in which, in a partially diagrammatic illustration.

DETAILED DESCRIPTION OF THE PREFERRED EMBODIMENTS

Figures 1, 2, 3, 4:
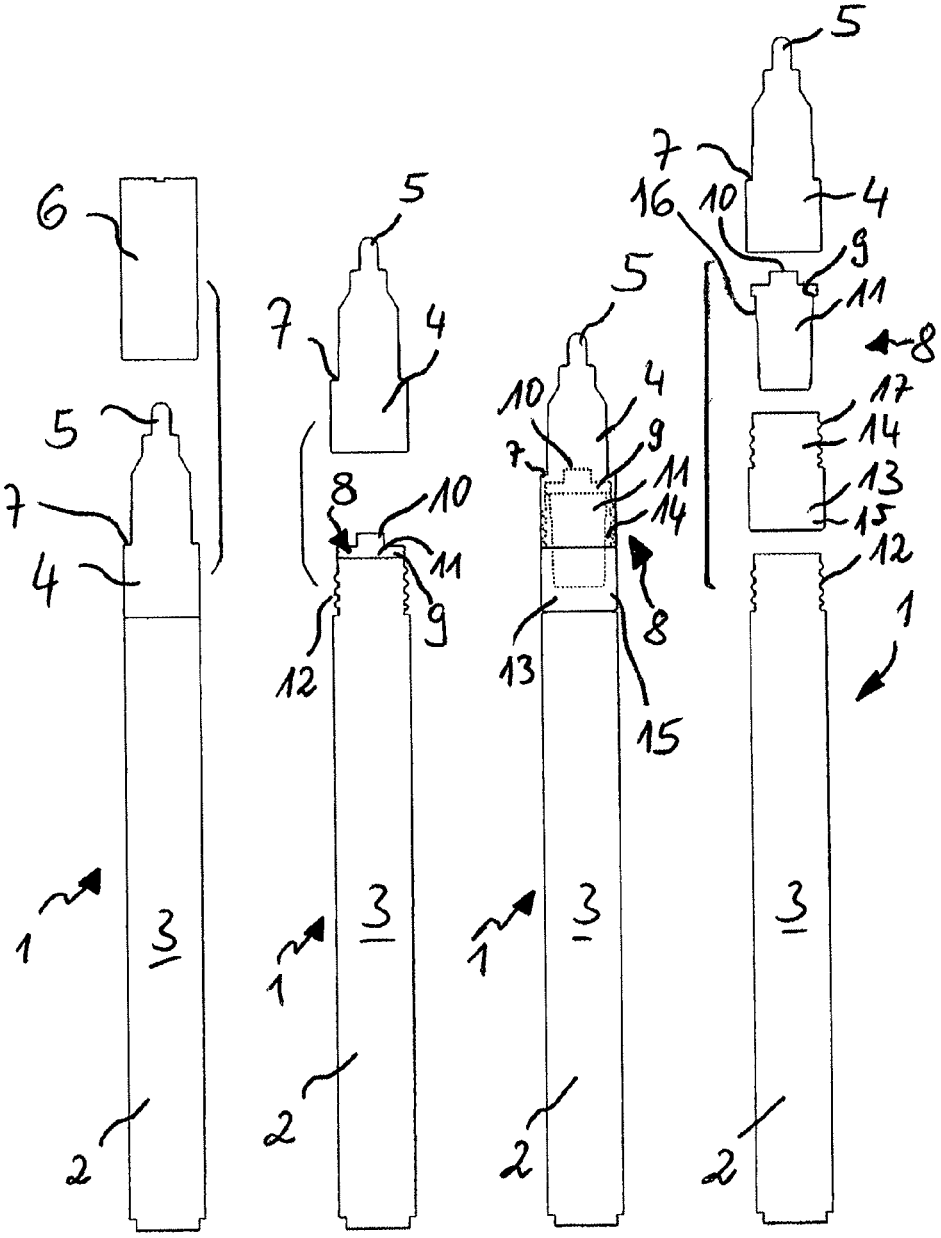
Fig. 1 (Prior Art) Fig. 2 (Prior Art) Fig. 3 Fig. 4
FIG. 1 is a planar side view of a first exemplary embodiment of an application tool from the prior art with a tool head which is arranged on the shaft and an associated protective cap which is not attached.
FIG. 2 is a planar side view of the application tool from FIG. 1 with a tool head which is removed from the shaft, without a protective cap.
FIG. 3 is a planar side view of one exemplary embodiment of an application tool according to the invention with a carrier part which is arranged between the shaft and the tool head and carries the valve.
FIG. 4 is a planar side view of the application tool from FIG. 3 in an exploded illustration with the shaft, the carrier part, the valve and the tool head.

An application tool from the prior art which is denoted overall by 1 can be seen in each case in FIGS. 1 and 2. By way of said application tool 1, a coating material which is not shown in further detail can be applied to a substrate surface which is likewise not shown.

The application tool 1 with a circular cross section has a shaft 2, on which the tool 1 can be gripped, the interior of the shaft forming a reservoir 3, in which the coating material is received. Furthermore, the tool head 4 can be seen on the application tool 1, which tool head 4 is in the use position in FIG. 1 and is screwed off in FIG. 2, and at the end of which faces away from the shaft 2, the applicator 5 is situated and is configured as a rounded tip which is formed from a fibrous material and engages into the interior of the tool head 4 with its region which faces away from the tip. Above the tool head 4, the protective cap 6 which is assigned to the application tool 1 can be seen, which protective cap 6 enters into a plugged connection with the tool head 4 when arranged on it and butts against a shoulder 7 of the tool head 4 in its use position with its end-side edge which faces the shaft.

FIG. 2, in which the tool head 4 is detached from the shaft 2, shows the circumstance more clearly that a valve 8 with a valve body 11 is arranged at that end of the shaft 2 which faces the tool head 4, which valve 8 closes the reservoir 3 and releases a quantity of the coating material upon actuation. This takes place by that section of the applicator 5 which faces the valve 8 and is situated within the tool head engaging into the opening 10 of the valve body 11 and actuating the valve 8 when pressure is exerted on the applicator 5 by way of the shaft. In its section which faces the tool head 4 and protrudes out of the shaft 2, the valve body 11 has an annular flange 9 which lies on the end-side edge of the shaft 2 and closes the latter, a section (not visible) of the valve body 11 forming a press fit with that inner wall section of the shaft 2 which encloses it, as a result of which the valve body is seated fixedly on the shaft 2. It can likewise be gathered from FIG. 2 that the shaft 2 is provided with an external thread 12 at its end which faces the tool head 4, which external thread 12 is in engagement with the internal thread (not visible) of the tool head 4 in the use position.

Although the application tool 1 according to the invention which is shown in FIGS. 3 and 4 is structurally similar to the application tool of FIGS. 1 and 2, it differs from the latter clearly by virtue of the fact that a carrier part 13 is discernibly arranged between the shaft 2 and the tool head 4 of the application tool 1, on which carrier part 13 the valve 8 with its valve body 11 is fixed, and by virtue of the fact that the carrier part 13 is provided such that it can be connected in each case releasably to the shaft 2 and the tool head 4 of the tool 1. The carrier part 13 is shown using dashed lines in FIG. 3.

As can be seen, in particular, in FIG. 3, the carrier part 13 receives the valve body 11 here over the substantial part of its longitudinal extent, namely over that part which protrudes from the annular flange 9 of the valve body 11 in the direction of the shaft 2. This part of the valve body 11 is received completely in the carrier part 13, as can be seen in FIG. 3 at the lower edge of the valve body 11 which is spaced apart upward from the downwardly facing edge of the carrier part 13. In FIGS. 3 and 4, the abovementioned annular flange 9 in turn forms the end-side upper termination of the carrier part 13, as a result of which the valve 8 can then be detached readily by way of unscrewing of the carrier part 13 from the shaft 2. This is to be attributed to the circumstance that the valve body 11 is now fixed on that opening of the sleeve-like carrier part 13 which faces the tool head 4, rather than on the shaft opening. Here, this fixing takes place in turn via a press fit which is realized by way of a section 16 of the valve body 11, which section 16 extends slightly in the direction of the annular flange and adjoins the latter. The carrier part 13 is divided substantially into two sections 14, 15: a section 15 which faces the shaft 2 and has an internal thread, and a section 14 which has an external thread 17 on a cross section which is recessed with respect to the cross section of the section 15. When the carrier part 13 is arranged between the shaft 2 and the tool head 4, the length of the application tool 1 overall is increased by the height of the section 15 of the carrier part 13.

Instead of the external thread 12 of FIGS. 1 and 2, in the use position of the carrier part 13 in FIG. 3, its external thread 17 is in engagement with the internal thread of the tool head 4, the role of which is in turn assumed by the internal thread (not shown) of the section 15 of the carrier part 13, which internal thread is now in engagement with the external thread 12 of the shaft 2. When the application tool of FIGS. 3 and 4 is being filled, the carrier part 13 can be gripped simply, can be detached from the shaft 2 and can be set aside, without negative effects such as contamination having to be feared as a result. Preferably, the reservoir 3 is configured in one piece with the shaft 2 as a cavity therein.

Accordingly, the above-described invention relates to an application tool 1 in the manner of a crayon or pencil, for applying a coating material to a substrate surface, having a shaft 2, on which the tool 1 can be gripped, and having a reservoir 3 which is accommodated in the shaft 2 for supplying with the coating material, the tool 1 being provided with a tool head 4 which has an applicator 5 and by means of which the coating material passes onto the substrate surface, and having a valve 8 which is arranged between the reservoir 3 and the tool head 4 with its valve body 11 which, upon actuation, changes from a closed position into an open position and, in the latter position, discharges a quantity of the coating material from the reservoir 3 to the applicator 5 for application to the surface. In order to provide an application tool 1 which firstly reduces the consumption of application tools 1 per se and secondly permits renewed filling of its reservoir 3 with a coating material reliably and cleanly, a carrier part 13 is arranged between the shaft 2 and the tool head 4 in the longitudinal extent of the application tool 1, which carrier part 13 receives and fixes the valve body 11 of the valve 8 with the predominant part of its longitudinal extent in the direction which faces away from the applicator 5, and the carrier part 13 is provided such that it can be connected in each case in a releasable manner to the shaft 2 and the tool head 4 of the tool 1.

The invention claimed is:

1. An application tool for applying a coating material to a substrate surface, comprising a shaft, by which the tool is grippable, a reservoir accommodated in the shaft for supplying the coating material, a tool head which has an applicator by which the coating material is adapted to pass onto the substrate surface, and a valve arranged between the reservoir and the tool head with a valve body which is actuatable from a closed position into an open position and, in the open position, discharges a quantity of the coating material from the reservoir to the applicator for application to the surface, a carrier part (13) arranged between the shaft (2) and the tool head (4) in a longitudinal extent of the application tool (1), said carrier part (13) receives the valve body (11) of the valve (8) and the carrier part (13) is formed by a sleeve and is provided such that it is releasably connectable to the shaft (2) and the tool head (4) of the tool (1), a radially extending annular flange is located on the valve body and covers one axial end of the sleeve facing the tool head in a use position of the valve body, and an end of the valve body that extends toward the reservoir is located within the sleeve.

2. The application tool as claimed in claim 1, wherein the valve (8) is held on the carrier part (13) by a fixing element, and one region of an outer side wall of the valve body (11) forms a press fit with an inner side wall of the carrier part (13).

3. The application tool as claimed in claim 1, wherein in each case one connecting element is provided at the ends of the carrier part (13) which face the tool head (4) and the shaft (2) of the tool (1).

4. The application tool as claimed in claim 1, wherein along a longitudinal extent thereof, the carrier part (13) has a region (15) with an internal thread and a region with an external thread (14).

5. The application tool as claimed in claim 4, wherein the external thread is provided on a recess of an outer wall of the carrier part (13).

6. The application tool as claimed in claim 1, wherein the shaft (2) of the tool (1) has a substantially constant, circular cross section over a longitudinal extent thereof.

7. The application tool as claimed in claim 1, wherein in a use position, the shaft (2), the carrier part (13) and a region of the tool head (4) which faces the carrier part (13) overall form a substantially cylindrical contour.

8. The application tool as claimed in claim 1, wherein the shaft (2) of the application tool (1) is provided from a flexurally rigid material.

9. The application tool as claimed in claim 1, wherein the shaft (2) of the application tool (1) is elastic at least in regions to allow temporary deformation upon appliance of a manually applied pressing force.

10. The application tool as claimed in claim 1, wherein the applicator (5) is configured with a fibrous structure or capillary structure which is capable of discharging the coating material.

11. The application tool as claimed in claim 10, further comprising coating materials in the reservoir, with at least one of physically drying paints or solvent-free paints on an acrylic basis being provided as the coating materials.

12. The application tool as claimed in claim 1, wherein the reservoir (3) is configured in one piece with the shaft (2) as a cavity therein.

13. The application tool as claimed in claim 1, further comprising a protective cap (6) in a region of its tool head (4).

* * * * *